United States Patent [19]

Burkert

[11] 4,282,096

[45] Aug. 4, 1981

[54] TAR SEPARATING DEVICE

[75] Inventor: Rudolf Burkert, Essen, Fed. Rep. of Germany

[73] Assignee: Didier Engineering GmbH, Fed. Rep. of Germany

[21] Appl. No.: 179,163

[22] Filed: Aug. 18, 1980

[30] Foreign Application Priority Data

Aug. 24, 1979 [DE] Fed. Rep. of Germany ..... 2934324

[51] Int. Cl.[3] ..... B01D 21/12

[52] U.S. Cl. ..... 210/182; 210/187; 210/526; 209/11; 209/162; 55/228; 208/187

[58] Field of Search ..... 209/1, 11, 155, 162, 209/461, 463, 464; 210/182, 187, 256, 526, 532.1, 73 W, 71, 72; 55/228, 421; 208/39, 186, 187; 201/41, 26; 202/263

[56] References Cited

U.S. PATENT DOCUMENTS

| | | | |
|---|---|---|---|
| 3,923,659 | 12/1975 | Ullrich | 210/187 X |
| 4,073,728 | 2/1978 | Ullrich et al. | 208/39 X |
| 4,149,971 | 4/1979 | Deuser et al. | 208/39 X |
| 4,154,584 | 5/1979 | Ullrich | 55/228 X |

FOREIGN PATENT DOCUMENTS

| | | | |
|---|---|---|---|
| 1258417 | 1/1968 | Fed. Rep. of Germany . | |
| 2331610 | 6/1977 | France | 208/187 |
| 125238 | 3/1959 | U.S.S.R. | 210/526 |

*Primary Examiner*—Ralph J. Hill

*Attorney, Agent, or Firm*—Wood, Herron & Evans

[57] ABSTRACT

A tar separating device for separating tar from hot rinsing liquid, specifically, the rinsing liquid of a receiver of a coke oven battery including a container having a rinsing liquid inlet, a solids removal device for removing solids from the liquid as the liquid enters the container, a tar dewatering chamber located in the container near the inlet such that the rinsing liquid entering the container flows over the outer surface of the chamber and a tube in the container for conveying rinsing liquid into the tar dewatering chamber. The inlet to the tube is located at a point distant from the rinsing liquid inlet to the container. At the tube inlet point, the temperature of the liquid is lower than that at the inlet. The present invention utilizes this temperature differential to effect a particularly distinct separation between the tar and the water. The device further includes means for separately removing the tar and the water from the dewatering chamber.

9 Claims, 1 Drawing Figure

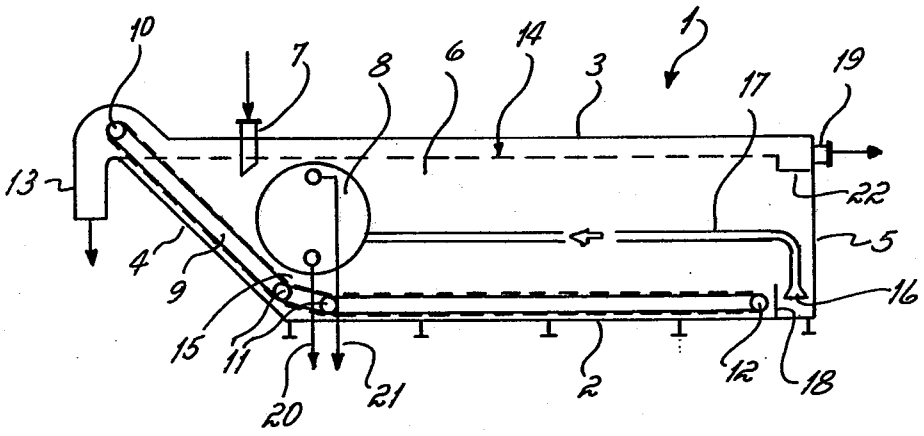
1
2
3
4
5
6
7
8
9
10
11
12
13
14
15
16
17
18
19
20
21
22

TAR SEPARATING DEVICE

BACKGROUND OF THE INVENTION

This invention relates to a tar separating device for separating tar from a hot rinsing liquid and, more particularly, to a device for separating tar from the rinsing material of the receiver of a coke oven battery.

This invention is intended to remove tar and solids from the rinsing material to make it possible to reuse the water for receiver sprinkling. It is desirable therefore that the separated tar have as low a water and solids content as possible. Tar separating devices comprising a separating chamber with an inlet for receiving the rinsing liquid, a solids removal device, and a chamber which is heated by the rinsing liquid are known as, for example, in German Pat. No. 12 58 417. In such a device, the rinsing liquid flows through the inlet into a thick tar chamber at the bottom of which is a solids removal device. Tar separation takes place in the chamber; however, essentially no temperature differential exists between the thick tar chamber and the separating container.

With a tar separating device according to the present state of the art, a residual water content of about 4% and a solids content of more than 6% can be obtained when tar separation is performed in one apparatus. To obtain better tar values, the tar separating device may be equipped with additional elements. For example, another thick tar separator may be provided for the separation of solid particles and/or a thin film evaporator may be provided for the further removal of water from the crude tar. However, it is necessary that additional energy be put into the system in the form of steam.

BRIEF DESCRIPTION OF THE INVENTION

It has now been found that the process of separating water, tar and solids substances proceeds optimally only under very specific conditions. For separating the tar from the water, a lower temperature than that of the rinsing fluid is desirable because at the lower temperature the viscosity of the tar and consequently its settling rate will increase considerably. However, when cooled too quickly, the tar droplets coagulate and thereby include water and solid particles thereby defeating the purpose of the invention which is the separation of water, tar and solid substances. In addition, water removal is impeded due to the hydrophilic properties of the solid particles.

The problem underlying the present invention, therefore, is to provide a tar separating device of the type described in which the solid particles are separted from the rinsing liquid as early as possible and in which the separation of the tar from the water takes place at a temperature lower than that of the water removal from the tar.

To this end, a tar separating device is provided including a container having an inlet for receiving a rinsing liquid, a solids removal device for removing solids from the liquid as the liquid enters the container, a tar dewatering chamber located in the container near the inlet such that the rinsing liquid entering the container flows over the outer surface of the chamber and a tube in the container for conveying liquid into the tar dewatering chamber. The feed to the tar dewatering chamber through the tube is located at a point removed from the inlet to the container and at a point where the solids have been removed from the rinsing liquid by means of the solids removal device. At this point, the temperature of the liquid is lower than at the inlet. As a result, the hot rinsing liquid entering the separating container through the inlet transmits part of its heat to the tar dewatering chamber. As the rinsing liquid enters the separating container, the larger solid particles separate immediately and are removed together with the subsequently settling solid particles by the solids removal device. As the rinsing liquid flows through the separating container, there occurs a cooling of it and simultaneously a separation of the tar from the water due to the difference in density. The water is pumped back to the receiver as rinsing liquid. The cool tar containing water is accumulated at a point distant from the inlet and returned to the tar dewatering chamber and is heated there by the rinsing liquid flowing into the container which in turn promotes the removal of water from the tar. The container has means for separately removing the tar and the water therefrom.

The device of the present invention provides a temperature profile which is favorable for the separation process, that is, for the separation of tar from the liquid and the removal of water from the tar. Without the addition of energy, it is therefore possible to obtain a crude tar with a water content of less than 1.5% and a solids content of less than 4%. Only a single tar separating device is required to achieve these results.

In a presently preferred embodiment of the invention, the tar dewatering chamber is arranged above the solids removal device and defines therewith a gap through which the rinsing liquid entering the container flows. The gap is so dimensioned that the rinsing material will wash the tar from the solid particles which are being transported by the solids removal device to a solids outlet.

In another embodiment of the invention, a pipeline connected with the tar dewatering chamber empties at the point distant from the inlet in the lower part of the separating container. The tar accumulating in this area of the pipeline mouth flows through the pipe into the tar dewatering chamber due to the static pressure which prevails in the separating container.

Other objects and advantages of the present invention will be apparent from the following detailed description taken with the accompanying drawing.

BRIEF DESCRIPTION OF THE DRAWING

FIG. 1 is a schematic cross-section illustration of the tar separating device of the present invention.

DETAILED DESCRIPTION OF THE INVENTION

A tar separating container 1 is of generally rectangular configuration and includes a bottom 2, a top 3 and inclined end wall 4, a rear end wall 5 and side walls 6. A rinsing liquid inlet 7 is provided in the top 3 which is connected to gas collecting line (not shown) which in turn is connected to the receiver of a coke oven battery. The inlet extends into the separating container 1 and is sealed by the liquid level 14 in the separating container 1. Below the inlet 7 and the separating container 1, is a horizontally disposed, cylindrical tar dewaterchamber 8. The chamber 8 extends from one side wall 6 to the other sidewall 6 and requires therefore no end walls of its own. The end walls of the the tar dewatering chamber 8 are formed by the sidewalls 6 themselves. The tar dewatering chamber 8 is so arranged that its center line is laterally offset relative to the inlet 7 and below it so that the rinsing liquid entering through the inlet 8 flows extensively across the outside of the shell of the tar dewatering chamber 8.

Parallel with the bottom 2 and the tilted end 4 there is a scraper conveyer 9 which forms a solids removal device and runs over reversing rollers 10, 11 and 12. At least one of the reversing rollers is powered. The reversing roller 10 lies at a solids removal opening 13 above the fill level 14 of the separating container 1. The reversing rollers 11 are so arranged that a gap 15 is created between the cylindrical tar dewatering chamber 8 and the scraper conveyer 9. The reversing roller 12 is located toward the rear, narrow end wall 5. Between the rear end wall 5 and the reversing roller 12 there is a mouth 16 of a pipe located which is directed toward the separating container bottom 2 and connected to the tar dewatering chamber 8. Provided between the reversing roller 12 and the mouth 16 is a weir 18. Arranged above it, as well on the rear narrow wall 5 and at the liquid level 14 of the separating container 1, is an outlet socket 19 which connects by way of a pump with the not illustrated receiver. Located before the outlet socket 19 is another weir 22 whose upper edge extends up to the liquid level 14.

Connected to the tar dewatering chamber 8, at the bottom, is a drainline 20 for crude tar and, above, a drainline 21 for water.

The operating mode of the described device is approximately as follows:

The rinsing liquid entering the separating container 1 through the inlet 7 has a temperature of, e.g., 80° C. It flows around the tar dewatering chamber 8 and heats the tar contained in it to approximately 78° C. The solid particles contained in the rinsing liquid are entrained by the continuously revolving scraper conveyer 9 and dumped through the opening 13. The rinsing liquid flows essentially through the gap 15 opposite to the feed direction of the scraper conveyer 9 and rinses the tar particles from the solid particles which are being conveyed by the scraper conveyer 9. While the rinsing liquid proceeds from the gap 15 to the rear wall 5, the tar separates from the water, due to the varying density of these components, and a cooling occurs at the same time. The water proceeds via the upper weir 22 and the drain socket 19 out of the separating container 1 and is pumped back to the receiver.

At the same time, the tar accumulates beside the rear wall 5 on the bottom 2 of the separating container where it is cooled to about 60° C. and dewatered to about 5%. Due to the static pressure prevailing in the separating container 1, the tar is forced through the line 17 into the tar dewatering chamber 8. It is heated there to about 78° C., causing a further water separation. The dewatered crude tar is drained through the line 20. The water accruing in the tar dewatering chamber 8 is routed through the line 21 into a silo.

I claim:

1. A tar separating device for separating tar from a hot rinsing liquid comprising:

a container having a rinsing liquid inlet, a solids removal device for removing solids from said liquid as said liquid enters said container, a tar dewatering chamber located in said container near said inlet such that the rinsing liquid entering said container flows over the outer surface of said chamber, tube means in said container for conveying rinsing liquid into said tar separating chamber, the inlet to said tube means being located at point distant from said rinsing liquid inlet where said liquid is lower in temperature than at said inlet, means for removing tar from said container, and means for removing water from said container.

2. The tar separating device according to claim 1 wherein the tar dewatering chamber is located above the solids removal device and defines a gap therebetween through which the rinsing liquid flows.

3. The tar separating device of claim 1 wherein the inlet to said tube means is located generally at the rear and bottom of the container and wherein the rinsing liquid inlet is located at the forward top end of the container.

4. The tar separating device of claim 1 wherein said solids removal device is a scraper conveyor.

5. The tar separating device of claim 1 wherein said container has a generally rectangular configuration including a top and bottom and end walls and elongated side walls.

6. The tar separating device of claim 5 wherein said tar dewatering chamber extends between said side walls of said container.

7. The tar separating device of claim 6 wherein said tar dewatering chamber has a cylindrical cross section.

8. The tar separating device of claim 1 wherein said container has a generally rectangular configuration including top and bottom walls, a rear end wall, an inclined front wall and a pair of side walls and wherein said solids removal device comprises a scraper conveyor disposed generally parallel to said inclined front wall and said bottom, said scraper conveyor reversing direction at a point spaced from said end wall and wherein said inlet to said tube means is disposed between said end wall and the end of said conveyor.

9. The tar separating device of claim 8 wherein said rinsing liquid inlet is located in the top front of said container and said dewatering chamber is located at the front end wall.

* * * * *

UNITED STATES PATENT AND TRADEMARK OFFICE

CERTIFICATE OF CORRECTION

PATENT NO. : 4,282,096

DATED : August 4, 1981

INVENTOR(S) : Rudolf Burkert

It is certified that error appears in the above—identified patent and that said Letters Patent is hereby corrected as shown below:

In column 3, line 3, "inlet 8" should be --inlet 7--.

Signed and Sealed this

*Twenty-seventh* Day of *October 1981*

[SEAL]

*Attest:*

GERALD J. MOSSINGHOFF

*Attesting Officer*

*Commissioner of Patents and Trademarks*